US005887869A

United States Patent [19]

Munz et al.

[11] Patent Number: 5,887,869

[45] Date of Patent: Mar. 30, 1999

[54] METHOD AND APPARATUS FOR COLLECTING AND TRANSPORTING COPY OR PRINT JOBS

[75] Inventors: Rolf Munz, Kernen; Jürgen Ries, Ostfildern, both of Germany

[73] Assignee: Eastman Kodak Company, Rochester, N.Y.

[21] Appl. No.: 18,811

[22] Filed: Feb. 4, 1998

[30] Foreign Application Priority Data

Feb. 22, 1997 [DE] Germany ..... 197 07 162.7

[51] Int. Cl.[6] ..... B65H 39/10

[52] U.S. Cl. ..... 271/294; 271/295; 271/298; 399/403; 399/405

[58] Field of Search ..... 270/52.03, 58.14, 270/58.19; 271/292, 294, 295, 298; 399/124, 403, 405

[56] References Cited

U.S. PATENT DOCUMENTS 3,224,825 12/1965 Sturgis et al. ..... 312/223
3,578,143 5/1971 Woodward .
5,328,170 7/1994 Coombs et al. .
5,531,430 7/1996 Tokunoh ..... 270/58.19
5,752,697 5/1998 Mandel et al. ..... 399/405

FOREIGN PATENT DOCUMENTS 0 241 273 4/1987 European Pat. Off. .

*Primary Examiner*—Arthur T. Grimley
*Assistant Examiner*—William A. Noé
*Attorney, Agent, or Firm*—Lawrence P. Kessler

[57] ABSTRACT

The apparatus for carrying out the method comprises a plurality of delivery trays arranged in the manner of a circulating bucket lift, which on the basis of user inputs can be freely selected and transported to a loading plane in which an inlet opening for the copy or print jobs also is located. An outlet opening is provided opposite the inlet opening, the individual delivery trays can be moved around a passthrough region which joins the inlet opening to the outlet opening, and each of the delivery trays can, in order to receive copy or print jobs, be slid into a loading position in the passthrough region and receives the copy or print job intended for that selected delivery tray.

8 Claims, 2 Drawing Sheets

METHOD AND APPARATUS FOR COLLECTING AND TRANSPORTING COPY OR PRINT JOBS

FIELD OF THE INVENTION

The invention relates to a method for collecting copy or print jobs in delivery trays arranged in the manner of a circulating bucket lift and for transporting said copy or print jobs.

The invention furthermore relates to an apparatus for collecting and transporting copy or print jobs, said apparatus having a plurality of delivery trays, arranged in the manner of a circulating bucket lift, which on the basis of user inputs can be freely selected and transported to a loading plane which is located opposite an inlet opening for the copy or print jobs.

BACKGROUND OF THE INVENTION

U.S. Pat. No. 3,578,143 concerns a control device for a motor-driven circulating storage apparatus that is configured as a storage facility for the deposition and retrieval of documents, files, and other objects. Arranged on a pair of chains are a plurality of trays or carriers which can be moved by means of the control apparatus along an endless loop selectably to a workstation. Once a selected carrier is positioned opposite the workstation, the carrier can be loaded in or unloaded from the workstation.

EP-A-0 241 273 discloses a sorting apparatus for copiers. The apparatus comprises a plurality of selectable delivery trays into which the copied sheets are deposited. For defined deposition of the individual sheets into the various delivery trays, a switcher is provided which is movable vertically with respect to the delivery trays. The switcher moves to the particular selected tray and thereby makes possible delivery of the copies into the selected trays. The delivery trays can be configured closably so as to grant access to the contents of the delivery trays only to a limited number of persons.

A sheet sorting apparatus is presented in the U.S. Pat. No. 5,328,170. The apparatus comprises several compartments, arranged in a vertical stack, into which printed sheets can be deposited from a telefax unit or the like. Switchers are provided on the respective compartments in order to guide the sheets into a selected compartment. Each compartment is in the form of a drawer, which normally is locked in the sheet-receiving position. A switcher closing apparatus brings the selected switcher into the sheet deflection position out of the normal position in which the sheet can pass by the compartments. The switcher closing apparatus is at the same time an actuation apparatus for selective unlocking of the normally locked drawers.

It is the object of the invention to create a method with which copy or print jobs intended for a selected number of users can be collected in a manner which protects against access by unauthorized persons. In addition, the method is also intended to allow the output of copy or print jobs which do not require confidentiality.

According to the invention, this is achieved in that the method comprises the following steps:

selecting the collecting function for the copy or print job currently being processed;

moving a delivery tray into a loading plane that coincides with an inlet opening for the copy or print jobs, the delivery tray moved into the loading plane being the one matching an identification number of the copy or print job;

sliding the delivery tray into a loading position into a passthrough region around which the delivery trays are arranged so as to circulate in the manner of a bucket lift, and collecting the copy or print job on the delivery tray; and moving the delivery tray with the collected copy or print job back such that the delivery trays ($\mathbf{20}_1, \mathbf{20}_2, \ldots, \mathbf{20}_N$) are arranged again in the manner of a bucket lift.

A further object of the invention is to provide an apparatus with which copy and print jobs can be both collected for a selected number of users in a manner protected against access by unauthorized persons, and also output directly to a finishing unit. In addition, the apparatus is intended to have a simple transport path for the copy or print jobs, in order to prevent damage or blockage.

According to the invention, this is achieved in that an outlet opening is provided opposite the inlet opening; that the individual delivery trays can be moved around a passthrough region which joins the inlet opening to the outlet opening; and that each of the delivery trays can, in order to receive copy or print jobs, be slid into a loading position in the passthrough region.

The method is advantageous in that copy or print jobs requiring confidentiality can be collected in a manner protected against access by unauthorized persons. At the same time, the method makes it possible for copy or print jobs that do not require confidentiality to be conveyed directly through the apparatus so as thereby to make possible output or finishing.

The apparatus is advantageous in that the two countervailing properties—the collection and transport of copy or print jobs—are combined. In this context, the linear transport path for the copy or print jobs is retained, and deflection thus prevented, when a copy or print job is to be directed to an output or finishing unit and is not to be collected in the apparatus. The apparatus furthermore has the advantage that copy or print jobs requiring confidentiality can be collected in a manner protected against access by unauthorized persons.

Further advantageous modifications of the invention are evident from the subclaims.

BRIEF DESCRIPTION OF THE DRAWINGS

The subject matter of the invention is described with reference to the embodiment depicted in the drawings, in which.

DETAILED DESCRIPTION OF THE INVENTION

Figure 1:
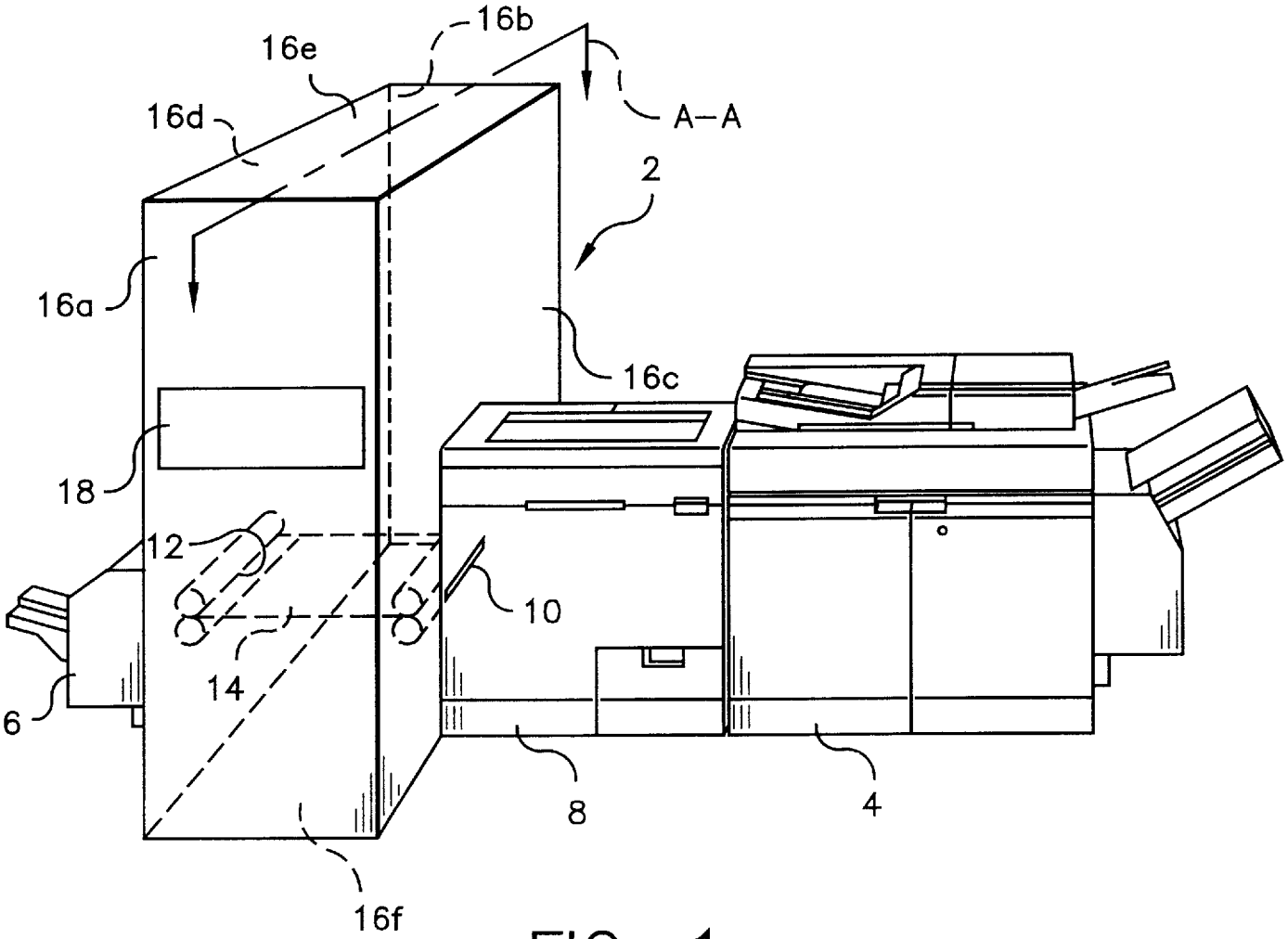
FIG. 1 shows a schematic layout of an apparatus with an upstream copier.

FIG. 1 shows the apparatus 2 for receiving copy or print jobs, said apparatus having an upstream copier/printer 4 and a finishing unit 6 downstream from apparatus 2. A finisher 8 can be interposed between copier/printer 4 and apparatus 2. The apparatus 2 is made up of outer panels 16*c* and 16*d* which face the units arranged upstream and downstream respectively, a cover panel 16*e* and a bottom panel 16*f*, and front end panel 16*a* and rear end panel 16*b*. Copier/printer 4, finisher 8, and finishing unit 6 do not require further discussion here, since they are sufficiently known from the prior art. It is self-evident that neither the number nor the type of the units upstream or downstream of the apparatus are limited by the depiction of FIGS. 1 and 2.

The apparatus 2 possesses an inlet opening 10 that is in communication with an outlet opening of copier/printer 4.

The copy or print jobs are thus transferred through inlet opening 10 to apparatus 2. A copy or print job comprises individual sheets or stapled brochures. Located downstream from apparatus 2 is finishing unit 6, the inlet opening (not depicted) of which is in communication with the outlet opening 12 of apparatus 2. In the embodiment shown in FIG. 1, a bypass transport system 14 is located between inlet opening 10 and outlet opening 12. By means of bypass transport system 14, the copy or print jobs delivered by the devices upstream from apparatus 2 are transported through the apparatus and are not collected within apparatus 2. A door 18 is provided in front end panel 16*a,* which is arranged parallel to the direction in which copy or print jobs are transported through apparatus 2. Door 18 allows access to the copy or print jobs deposited in the interior of apparatus 2. Door 18 can be equipped with a lock (not shown) in order to prevent unauthorized access to copy or print jobs collected in the interior of the apparatus.

Figure 2:
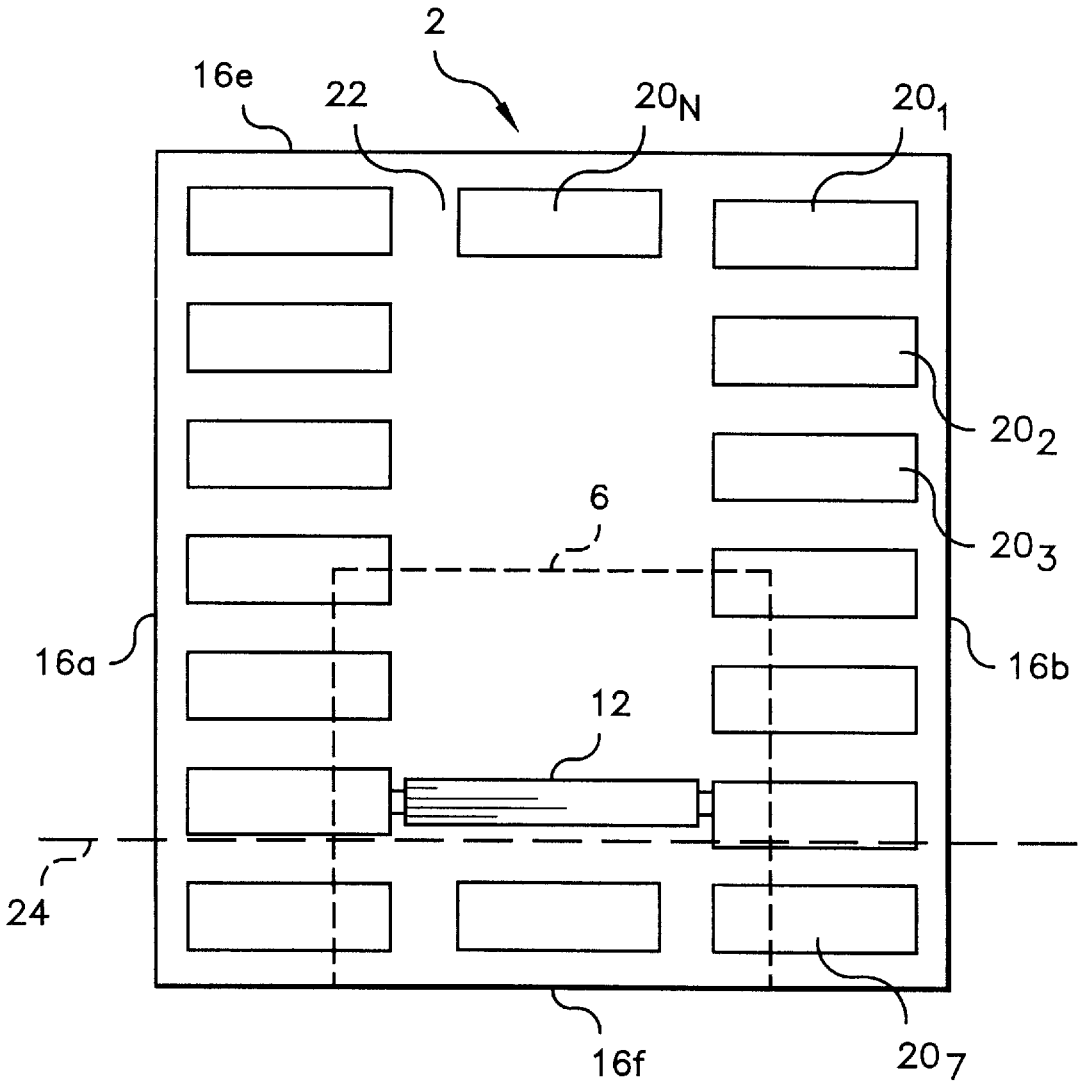
FIG. 2 shows a cross section through the apparatus of FIG. 1, along line A—A.

The internal configuration of the apparatus is evident from FIG. 2, which depicts a cross section through apparatus 2 along line A—A (see FIG. 1). Located in the interior of apparatus 2 is a plurality of delivery trays $\mathbf{20}_1, \mathbf{20}_2, \ldots, \mathbf{20}_N$, which are arranged, in the manner of a circulating bucket lift, in the interior of apparatus 2 so that they move up or down along the front and rear end panels 16*a* and 16*b,* respectively, and along bottom panel 16*f* or cover panel 16*e* to the rear or front end panel 16*a* or 16*b,* respectively. The length of the cover and bottom panels is such that at least three delivery trays are located parallel to one of said panels 16*e* or 16*f.* A passthrough region 22 is constituted between the delivery trays that are moving along front end panel 16*a,* and the delivery trays that are moving along rear end panel 16*b.* Passthrough region 22 allows communication between inlet opening 10 and outlet opening 12 of apparatus 2, both of which are located in a loading plane 24.

The bypass transport system 14, which can be brought into the loading plane in accordance with user inputs, is provided in one of the delivery trays. As a result, copy or print jobs can be transported directly from inlet opening 10 to outlet opening 12 of the apparatus, and there output to finishing unit 6. The other delivery trays that can be used for collecting copy or print jobs can be selected and brought into the loading plane in accordance with the respective user inputs or on the basis of signals from the copy or print jobs currently being processed.

As already mentioned above, the apparatus serves for receiving copied material from copy or print jobs. In the method described below, copied material supplied from finisher 8 can consist of individual sheets or of stapled brochures.

The apparatus 2 (see FIG. 2) possesses delivery trays $\mathbf{20}_1, \mathbf{20}_2, \ldots, \mathbf{20}_N$ which are arranged in circulating fashion as if in a bucket lift system. Said individual delivery trays $\mathbf{20}_1, \mathbf{20}_2, \ldots, \mathbf{20}_N$ are addressable and closable, so that the sheets/brochures stacked therein can be protected from unauthorized access. Each of the delivery trays $\mathbf{20}_1, \mathbf{20}_2, \ldots, \mathbf{20}_N$ can, for example, have assigned to it an address that is correlated in each case with a user number. When individual sheets or brochures are then delivered from finisher 8, they can then, addressed on the basis of the respective user numbers, be conveyed to the individual delivery trays $\mathbf{20}_1, \mathbf{20}_2, \ldots, \mathbf{20}_N$. For this purpose, the delivery trays $\mathbf{20}_1, \mathbf{20}_2, \ldots, \mathbf{20}_N$ are moved in circulating fashion with the bucket lift system until the addressed one has reached the loading plane 24. To allow the copied material to be received into the delivery tray, said tray is automatically slid out of the circulating bucket lift system into a loading position on the loading plane. Once the copied material has been collected on the delivery tray, it is slid back into the bucket lift system, and another delivery tray can be moved into the loading position.

The finisher 8 can be operated in a known manner as an output accessory, the copied material being delivered to the finishing unit 6 which functions as an output hopper. This is possible because the bypass transport system 14, rather than a delivery tray, is in the loading position in the loading plane. If colletion of copied material into one of the delivery trays provided for the purpose is not selected, the bucket lift system is moved in such a way that the delivery tray having bypass transport system 14 is located in the loading plane. Bypass transport system 14 is automatically slid into the loading position, and positioned in such a way that inlet opening 10 communicates with outlet opening 12 of apparatus 2. The copied material entering from finisher 8 is conveyed through the apparatus directly to the output hopper (finishing unit 6). Once this direct-output of copy or print job has been processed, bypass transport system 14 is slid back into the delivery tray and another selected delivery tray is moved by the bucket lift system into the loading plane.

The invention has been described with reference to a preferred embodiment, but modifications be carried out by those skilled in the art without leaving the scope of protection of the claims below.

What is claimed is:

1. A method for collecting copy or print jobs into delivery trays $(\mathbf{20}_1, \mathbf{20}_2, \ldots, \mathbf{20}_N)$ arranged in the manner of a circulating bucket lift, and for transporting said copy or print jobs to finish unit (6), comprising following steps:

upon selection of a function for collecting the copy or print job currently being processed:

moving a delivery tray into a loading plane (24) that coincides with an inlet opening (10) for said copy or print jobs, said delivery tray moved into said loading plane (24) being the one matching an identification number of said copy or print job;

sliding said delivery tray a loading position in a passthrough region (22) around which said delivery trays $(\mathbf{20}_1, \mathbf{20}_2, \ldots, \mathbf{20}_N)$ are arranged so as to circulate in the manner of a bucket lift, and collecting said copy or print job on said delivery tray, and moving said delivery tray with said collected copy or print job back such that said delivery trays $(\mathbf{20}_1, \mathbf{20}_2, \ldots, \mathbf{20}_N)$ are arranged again in the manner of a bucket lift; and upon selection of a function for transporting said copy or print job to a finishing unit (6):

moving a delivery tray which comprises a bypass transport system (14) into said loading plane (24), which coincides with said inlet opening (10) for the copy or print jobs;

sliding said bypass transport system (14) into said loading position in said passthrough region (22);

conveying said copy or print job entering through said inlet opening (10) to an outlet opening (12) that communicates with said finishing unit (6); and moving said bypass transport system (14) back into the delivery tray provided for it such that the delivery trays $(\mathbf{20}_1, \mathbf{20}_2, \ldots, \mathbf{20}_N)$ are arranged again in the manner of a bucket lift.

2. The job collecting method of claim 1, wherein the identification numbers of said delivery tray and of said copy or print job match a user number.

3. Apparatus (2) for collecting and transporting copy or print jobs, said apparatus having a plurality of delivery trays ($\mathbf{20}_1$, $\mathbf{20}_2$, . . . , $\mathbf{20}_N$), arranged in the manner of a circulating bucket lift, which on the basis of user inputs can be freely selected and transported to a loading plane (24) in which an inlet opening (10) for said copy or print jobs is also located, characterized in that an outlet opening (12) is provided opposite an inlet opening (10); said individual delivery trays ($\mathbf{20}_1$, $\mathbf{20}_2$, . . . , $\mathbf{20}_N$) can be moved around a passthrough region (22) which joins said inlet opening (10) to said outlet opening (12); and each of said delivery trays ($\mathbf{20}_1$, $\mathbf{20}_2$, . . . , $\mathbf{20}_N$) can, in order to receive said copy or print jobs, be slid into a loading position in said passthrough region (22).

4. The job collecting apparatus of in claim 3, characterized in that one of the delivery trays comprises a bypass transport system (14) that can be slid into the loading position and joins said inlet opening (10) to said outlet opening (12) in such a way that the copy or print jobs, entering from an upstream device such as a finisher (8) through inlet opening (10), can be conveyed directly to said outlet opening (12) and transferred to a downstream finishing unit (6).

5. The job collecting apparatus of claim 3, characterized in that each of the delivery trays ($\mathbf{20}_1$, $\mathbf{20}_2$, . . . , $\mathbf{20}_N$) is arranged substantially horizontally in order to receive copy or print jobs.

6. The job collecting apparatus of claim 3, characterized in that an address or identification number is assigned to each of the delivery trays ($\mathbf{20}_1$, $\mathbf{20}_2$, . . . , $\mathbf{20}_N$) and is correlated in each case with a user number, so that the correct delivery tray for the copy or print job, currently being processed, of a specific user can automatically be selected.

7. The job collecting apparatus of claim 6, characterized in that the apparatus is configured closably in order to prevent access by an unauthorized user to copy or print jobs deposited in the delivery trays ($\mathbf{20}_1$, $\mathbf{20}_2$, . . . , $\mathbf{20}_N$).

8. The job collecting apparatus of claim 7, characterized in that a door (18) is provided in an end panel (16*a*, 16*b*) of the apparatus (2) and is configured closably so that the user-specific copy or print jobs collected in the delivery trays ($\mathbf{20}_1$, $\mathbf{20}_2$, . . . , $\mathbf{20}_N$) can be removed therefrom by the users having access authorization.

* * * * *